US011202476B2

(12) United States Patent
Piatt

(10) Patent No.: US 11,202,476 B2
(45) Date of Patent: Dec. 21, 2021

(54) RETAINING RING FOR RESPIRATORY FACE MASKS

(71) Applicant: ZVerse, Inc., West Columbia, SC (US)

(72) Inventor: Michael J. Piatt, Springboro, OH (US)

(73) Assignee: ZVerse, Inc., West Columbia, SC (US)

( * ) Notice: Subject to any disclaimer, the term of this patent is extended or adjusted under 35 U.S.C. 154(b) by 0 days.

(21) Appl. No.: 17/326,939

(22) Filed: May 21, 2021

(65) Prior Publication Data

US 2021/0361004 A1 Nov. 25, 2021

Related U.S. Application Data

(60) Provisional application No. 63/027,956, filed on May 21, 2020.

(51) Int. Cl.
*A41D 13/11* (2006.01)

(52) U.S. Cl.
CPC ..... *A41D 13/1161* (2013.01); *A41D 13/1138* (2013.01); *A41D 13/11* (2013.01); *A41D 13/1176* (2013.01)

(58) Field of Classification Search
CPC ..... A41D 13/1161; A41D 13/1138; A41D 13/11; A41D 13/1176
USPC ..... 128/206.19
See application file for complete search history.

(56) References Cited

U.S. PATENT DOCUMENTS 2,067,026 A * 1/1937 Schwartz ..... A41D 13/11 128/206.12
2,578,007 A * 12/1951 Hill ..... A41D 13/11 128/206.17
3,695,265 A * 10/1972 Brevik ..... A41D 13/1176 128/206.14
4,090,510 A * 5/1978 Segersten ..... A41D 13/11 128/206.12
4,279,037 A * 7/1981 Morgan ..... A42B 3/08 2/421
4,467,799 A * 8/1984 Steinberg ..... A41D 13/1192 128/206.14
4,520,509 A * 6/1985 Ward ..... A41D 13/1146 128/206.17
4,641,379 A * 2/1987 Martin ..... A41D 13/1161 128/206.28
4,951,664 A * 8/1990 Niemeyer ..... A62B 18/025 128/205.27
5,237,986 A * 8/1993 Seppala ..... A41D 13/1146 128/201.23

(Continued)

*Primary Examiner* — Khaled Annis
*Assistant Examiner* — Dakota Marin
(74) *Attorney, Agent, or Firm* — Tracy Jong Law Firm; Cheng Ning Jong; Louis Reale

(57) ABSTRACT

A continuous elongated ring configured to engage a filtration textile to a nose-mouth perimeter of a user, said continuous elongated ring including an upper curvilinear portion adapted to engage said filtration textile disposed about a nasal periphery of the user; said upper curvilinear portion including a pair of attachment features adapted to fastenly receive an upper support strap configured to engage the user's head, and a lower curvilinear portion adapted to engage said filtration textile disposed about a mouth periphery of the user, the lower curvilinear portion including a pair of attachment features adapted to fastenly receive a lower support strap configured to engage the user's head.

13 Claims, 10 Drawing Sheets

(56) References Cited

U.S. PATENT DOCUMENTS 5,727,544 A * 3/1998 Miura ..... A41D 13/11
128/201.13
5,863,312 A * 1/1999 Wolfe ..... B01D 46/10
55/495
6,123,077 A * 9/2000 Bostock ..... A41D 13/1115
128/206.12
6,338,340 B1 * 1/2002 Finch ..... A62B 18/084
128/205.27
6,868,984 B2 * 3/2005 Griesbach, III ..... A41D 13/11
221/303
7,017,577 B2 * 3/2006 Matich ..... A62B 18/08
128/206.14
8,113,201 B2 * 2/2012 Steindorf ..... A41D 13/1138
128/206.15
8,381,727 B2 * 2/2013 Matich ..... A41D 13/1138
128/206.14
8,783,253 B2 * 7/2014 Flaherty ..... A41D 13/1138
128/206.13
9,408,424 B2 * 8/2016 Noh ..... A41D 13/1138
10,434,341 B1 * 10/2019 Torbenson ..... A62B 18/00
10,639,506 B2 * 5/2020 Walker ..... A62B 23/025
2005/0170726 A1 * 8/2005 Brunson ..... D04H 1/4374
442/327
2006/0254591 A1 * 11/2006 Marx ..... A62B 23/02
128/206.19
2007/0050883 A1 * 3/2007 Matich ..... A41D 13/0005
2/69
2009/0078266 A1 * 3/2009 Stepan ..... A62B 23/025
128/206.19
2009/0320849 A1 * 12/2009 Biedermann ..... A41D 13/1192
128/206.28
2012/0125343 A1 * 5/2012 Tai ..... A41D 13/1138
128/206.13
2014/0215696 A1 * 8/2014 Polit ..... A61F 11/08
2/423
2017/0303608 A1 * 10/2017 Chen ..... A41D 13/1161
2018/0008848 A1 * 1/2018 Moulton ..... A41D 13/1138
2021/0322796 A1 * 10/2021 Hubbard ..... A62B 23/025

* cited by examiner

RETAINING RING FOR RESPIRATORY FACE MASKS

PRIORITY CLAIM AND RELATED APPLICATIONS

This non-provisional application claims the benefit of priority from provisional application U.S. Ser. No. 63/027,956 filed on May 21, 2020. Said application is incorporated by reference in its entirety.

FIELD OF THE INVENTION

The present invention relates to protective face mask systems, particularly systems directed to air respiration filtering. More specifically, one aspect of the present invention is directed to a retaining ring assembly configured to enhance the seal between a filtration textile and the nose-mouth perimeter of a user.

BACKGROUND OF THE INVENTION

One of the primary functions or goals of a typical respiratory face mask is to provide a protective hygienic barrier between the user and the user's external environment. The primary focus of the present disclosure will be directed to systems configured to directly protect the respiratory system, which includes face masks and like configurations that cover both the nose and mouth. Depending on the features provided by a given face mask system, e.g., the mask design, the type of filter component(s) incorporated and the like, the unit can protect the user from their environment, protect objects/substances in the environment from the user, protect other people/animals in the environment from the user and combinations thereof. Selection of the filtration textile(s) or filter component(s) will determine what type of protection the face mask system can ultimately provide, e.g., the type of protection provided (e.g., microorganism filtration, particulate matter filtration, etc.), its filtration effectiveness, the expected life of the unit and the like.

During the approximate time period between late 2019 and early 2020, humankind was introduced to the COVID-19 virus. As a first line of defense, many healthcare professionals as well as like-minded professionals and organizations, quickly provided the public with basic protective measures, such as: avoiding crowds, having individuals maintain a distance of at least 6 feet away from others (Social Distancing), wearing a face mask in public settings or when requested and the like. Virtually all health organizations highly recommend that certain individuals persistently wear face masks, e.g., those with compromised immune systems, preexisting medical conditions, healthcare professionals working in patient filled environments and the like. Additional situations where individuals may be required to persistently don masks, include those having duties that require interactions with articles or substances that are being prepared for the public, such as individuals engaged in dispensing medications, food preparation, library services, general delivery services and the like.

Emergencies, including pandemics due to airborne pathogens, can create a colossal demand associated with protecting large number of individuals from essentially all the potential sources of pathogens and the like. One of the simplest means of protection is the use of respiratory type of face masks. Even the simplest of face mask configurations possess at least some ability to capture moisture droplets emitted from individuals, thereby providing at least some protection for themselves as well as bystanders from such pathogen laden droplets.

The demand for respiratory type of face masks during states of emergency can be overwhelming. The well-respected N95 compliant type face masks are predictably sought after and quickly become unavailable. N95 compliant face masks, when properly attached, filter about 95% of the airborne contaminates they were predetermined to protect against; both inhaled and exhaled air are both filtered by N95 type face masks.

N95 type face masks are typically more expensive than standard surgical masks and require a tight fit against the user's face to minimize leakage. Accordingly, many find such N95 face masks uncomfortable to wear because of limited internal air circulation, as well as the significant pressure drop across the filter material, which demands additional breathing effort from the wearer. During a pandemic, or the like, such face masks may be solely be reserved for medical personnel and quickly become unavailable for use by the general population. As a compromise, the general populous may be forced to settle for less effective types of face masks, which include, but not limited to: surgical masks, looser fitting textile type face masks, sheets of cloth/fabric configured into a face mask geometry, makeshift configurations and the like. Compared to N95 type face masks, such loose fitting type masks forego a substantial portion of potential protection. The primary cause of performance inequality, compared to an N95 face mask system, is due to the various gaps between the filtration textile and the nose-mouth perimeter of the user. The typical, standalone loosely fitted face mask is usually not configured to produce the required, substantially sealed inner volume required to filter both user inhalation and exhalation air.

In the respiratory face mask arts, it is apparent that there is a need to enable the aforementioned, loosely fitted types of face mask systems to function more like the tighter, more effective face mask systems, e.g., the N95 series of face masks. Additionally, in times of emergency, when premium face mask devices may be in short supply, there is an obvious need to possess the means for quick assembly the most effective face mask system possible, given the materials available.

Certain embodiments of the present invention, including all relevant components, can be configured to be contained in an envelope, such that the face mask system can be shipped using a standard United States Postal Service (USPS) first-class stamp. Other face mask embodiments can be configured such that they can be made accessible via ordinary vending machines. Still other embodiments can be packaged as a compact kit for shipment to emergency locations to aid in relief efforts.

SUMMARY OF THE INVENTION

The present disclosure provides face mask devices or accessories directed to the functional improvement of commercially available or makeshift type of face mask systems for air respiration filtering. Presented are disclosures of face mask devices and improvement systems that overcome the aforementioned disadvantages of well-known devices and comparable systems. One exemplary aspect of the present invention addresses the poor user-mask interface or face mask perimeter sealing issues pertaining to loose-fitting masks and the like. Additionally, in times of emergency, when premium face mask devices may be in short supply, the present invention provides the means to quickly assemble the most effective face mask system possible, given the materials available.

It is understood that, in the present population, there are a multitude of nose shapes and sizes, mouth shapes and sizes and combinations thereof. Given such a vast variation in facial features in the present population, it is expected that each individual will experience their own unique fit and experience provided from various continuous elongated ring (CER) face mask designs or configurations. CER device design options that can enhance comfort and functionality include, but not limited to, the support strap(s) attachment locations on the CER, CER geometry configured to adequately cover and engage the nose-mouth perimeter of the user and the engagement pressures from various portions of the CER device.

Another comfort/functionality factor is directed to the flexibility of the CER device and/or specific portions thereon. One means for adjusting or controlling CER flexibility/stiffness is via material selection in combination with variations in CER device thickness and/or width (entire unit or portions thereon). For example, a thicker CER nose portion would provide enhanced engagement/sealing for certain nose geometries and so forth.

Accordingly, it is an object of the present invention to provide a respiratory face mask retaining ring or continuous elongated ring (CER) that is flexible and able to conform to a user's nose-mouth perimeter. Exemplary devices can be fabricated from a variety of semi-rigid polymeric type materials.

It is another object of certain embodiments of present invention to provide a CER including at least one engaged filtration textile, for providing a hygienic barrier between the user and the user's external environment. The hygienic barrier is enabled by a filter component, which is selected to filter/eliminate or reduce the transmission of predetermined airborne contaminates.

It is yet another object of certain embodiments of present invention to attach a spongy material attached onto at least a portion of the back side or user's side of the CER to provide additional user comfort and improve the seal between the filtration textile and nose-mouth perimeter of the user. In some embodiments, the spongy material can also provide a friction type anchor for further engaging the filtration textile to prevent slippage.

It is a further object of the present invention to provide a CER configured to provide a substantially gap-free engagement between the filtration textile and the user, thereby producing a substantially sealed inner volume disposed between said filtration textile and the user.

It is another object of certain embodiments of present invention to provide a CER configured to substantially engage a wide variety of filtration textiles for producing a substantially sealed inner volume. Filtration textiles include, but are not limited to loose fitting commercial or makeshift type face masks, pathogenic protective filtration materials in sheet form, particulate protective filtration materials in sheet form, HEPA compliant materials in sheet form or any air permeable material in sheet form. Additionally, composite filtration textiles comprised of two or more sheets of filtration material will provide a means for additional filtration.

It is a further object of the present invention to provide a CER comprising an upper curvilinear portion configured to engage a filtration textile about the nasal periphery of a user and a lower curvilinear portion configured to engage the filtration textile about the mouth periphery of the user.

It is another object of certain embodiments of present invention to provide a CER including at least one pair of attachment features attached thereon configured to attach to at least one support strap for engagement with the user's head, ears, wearable accessories (e.g., hat, wig, etc.) and the like.

It is another object of this invention to provide a relatively simple system that is economical from the viewpoint of the manufacturer and consumer, is susceptible to low manufacturing costs with regard to labor and materials and which accordingly evokes low prices for the consuming public, thereby making it economically available to the buying public.

Whereas there may be many embodiments of the present invention, each embodiment may meet one or more of the foregoing recited objects in any combination. It is not intended that each embodiment will necessarily meet each objective.

Thus, having broadly outlined the more important features of the present invention in order that the detailed description thereof may be better understood and that the present contribution to the art may be better appreciated, there are, of course, additional features of the present invention that will be described herein and will form a part of the subject matter of this specification.

In this respect, before explaining at least one embodiment of the invention in detail, it is to be understood that the invention is not limited in its application to the details of construction and the arrangements of the components set forth in the following description or illustrated in the drawings. The present invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent construction insofar as they do not depart from the spirit and scope of the conception regarded as the present invention.

BRIEF DESCRIPTION OF THE DRAWINGS

The ensuing detailed description section makes reference to the annexed drawings. An enhanced understanding of the present invention will become evident when consideration is given to the detailed description thereof and objects other than the aforementioned become apparent. The invention will be described by reference to the specification and the annexed drawings, in which like numerals refer to like elements and wherein.

DEFINITIONS OF TERMS USED IN THIS SPECIFICATION

Figure 1:
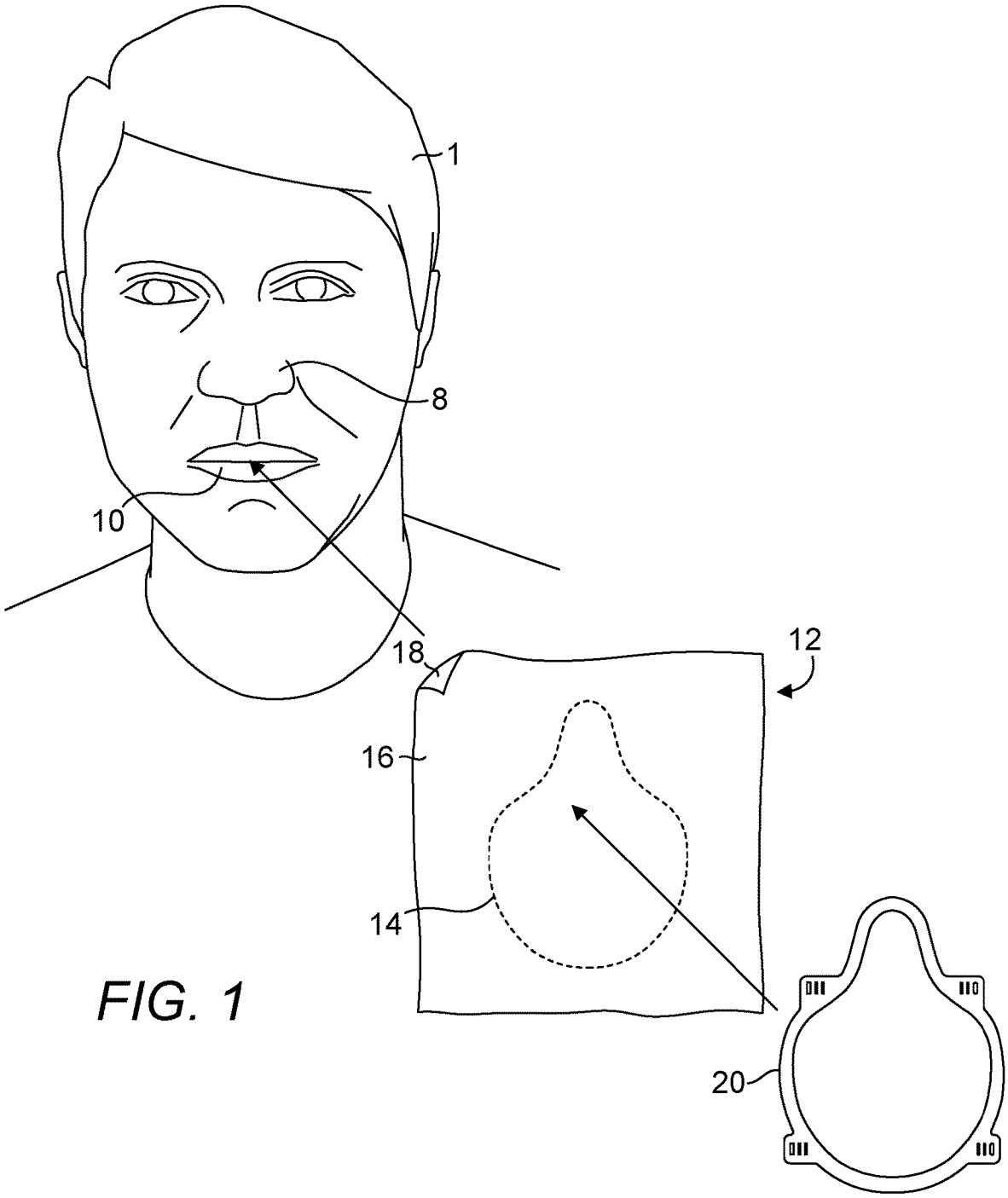
FIG. 1 illustrates an exploded component view of an exemplary continuous elongated ring (CER) system, depicting the positional relationships among the user, a filtration textile and a CER.

The continuous elongated ring (CER) device and/or system for improving existing respiratory protective face mask type systems, discussed throughout this disclosure, shall have equivalent nomenclature, including, but not limited to: the device, the face mask system, the unit, CER, the CER system, the accessory, the system, the present invention, or the invention. The terms "elongated" and "ring" as used in this disclosure, shall be defined as any non-circular geometry. The term "aperture" shall be defined as any hole or opening, of any shape or geometry, that provides an open path from the continuous elongated ring's front surface to back surface. Additionally, the term "exemplary" shall possess a single meaning throughout this disclosure; wherein the sole meaning is directed to: serving as an example, instance, or illustration.

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

Descriptions and explanations shall be referenced based upon the viewpoint of the user. The term others or bystanders shall be defined as individuals within the immediate environment of the user, having a reasonable probability of receiving an airborne pathogen from the user.

The term filtration textile shall be broadly understood to be any flexible, air permeable material. The term includes standard type of commercial masks (e.g., surgical face masks and the like), home-made face masks. Also included are face mask systems fabricated from: simple handkerchief products and air permeable sheet material comprised from any synthetic, natural, textile, fabric, paper product, fiber blended composite materials and the like.

The term "pair of attachment features" shall be understood to comprise two attachment features, portions or the like, where each attachment feature is configured to receive one end of a support strap, thereby forming a loop for engaging the user's head or ears. For example, a pair of attachment features will include two portions, e.g., a right and a left attachment feature, a first and a second attachment feature, a first and second upper attachment feature, a first and second lower attachment feature or the like.

PARTS/FEATURES LIST

1—user
2—nose-mouth perimeter
4—mouth periphery
6—nasal periphery
8—nose
10—mouth
12—filtration textile
14—engagement perimeter, induced onto filtration textile by continuous elongated ring (CER)
16—front face
18—rear or back face
20—CER including tri-aperture attachment features
22—upper curvilinear portion of CER
24—lower curvilinear portion of CER
26—upper attachment features (first and second upper attachment features)
28—lower attachment features (first and second lower attachment features)
30—nasal curvature
32—mouth curvature
33—CER including single aperture attachment features
34—upper pair attachment features, single aperture
36—lower pair attachment features, single aperture
37—width
38—perimeter strip
40—support strap
41—tri-aperture
42—first slot of tri-aperture attachment feature
44—second slot of tri-aperture attachment feature
46—third slot of tri-aperture attachment feature
48—exemplary means of attachment
50—thickness of CER
52—user's side (back side of CER)
54—outside face (the side facing away from user)
56—surgical face mask
58—support ear loops of surgical face mask
60—pleats
62—front surface of surgical mask
63—handkerchief (a type of filtration textile 12)
64—upper support strap(s)
66—lower support strap(s)
68—surgical mask (embodiment without attached straps)
70—ears (right and left user's ears)
72—ear loop (for user's right and left ears)

PARTICULAR ADVANTAGES OF THE INVENTION

The present invention provides cost-effective, efficient solutions to several issues directed to respirator type of face masks. One focus of the present invention is to provide an apparatus capable of enhancing the performance of existing loose fitting face masks, such as surgical face masks. Other aspects of the present invention focus on providing a means for quickly and inexpensively constructing a functional face mask system from a wide variety of filtration textiles that are available in sheet form, ranging from handkerchiefs to N95 capable materials.

DETAILED DESCRIPTION

With reference to the drawings of the present invention, several embodiments pertaining to the faucet system of the present invention thereof will be described. In describing the embodiments illustrated in the drawings, specific terminology will be used for the sake of clarity. However, the invention is not intended to be limited to the specific terms so selected and it is to be understood that each specific term includes all technical equivalents that operate in a similar manner to accomplish a similar purpose. Terminology of similar import other than the words specifically mentioned above likewise is to be considered as being used for purposes of convenience rather than in any limiting sense.

It must be noted that as used herein and in the appended claims, the singular forms "a", "an" and "the" include plural reference unless the context clearly dictates otherwise. As well, the terms "a" (or "an"), "one or more" and "at least one" can be used interchangeably herein. It is also to be noted that the terms "comprising", "including", "characterized by", "possessing" and "having" are all to be interpreted as open ended terms, are all considered equivalent terms and are used interchangeably.

FIG. 1 illustrates an exploded component view of an exemplary continuous elongated ring (CER) 20 system, depicting the positional relationships among user 1, a filtration textile 12 and an exemplary CER 20. Filtration textile 12 is comprised of two surfaces or faces, a front face 16, and a rear or back face 18. Detailed is the face of user 1 having mouth 10 and nose 8, the combination forming a nose-mouth perimeter 2 (best depicted in FIG. 2). Next in the positional lineage is filtration textile 12, possessing the appropriate geometry and having sufficient area to accommodate engagement perimeter 14 highlighted on filtration textile 12. To ensure the best CER 20 system fit for user 1, engagement perimeter 14, formed by CER 20, should be substantially congruous to user's nose-mouth perimeter 2, having an equal to or larger area thereof.

Figure 2:
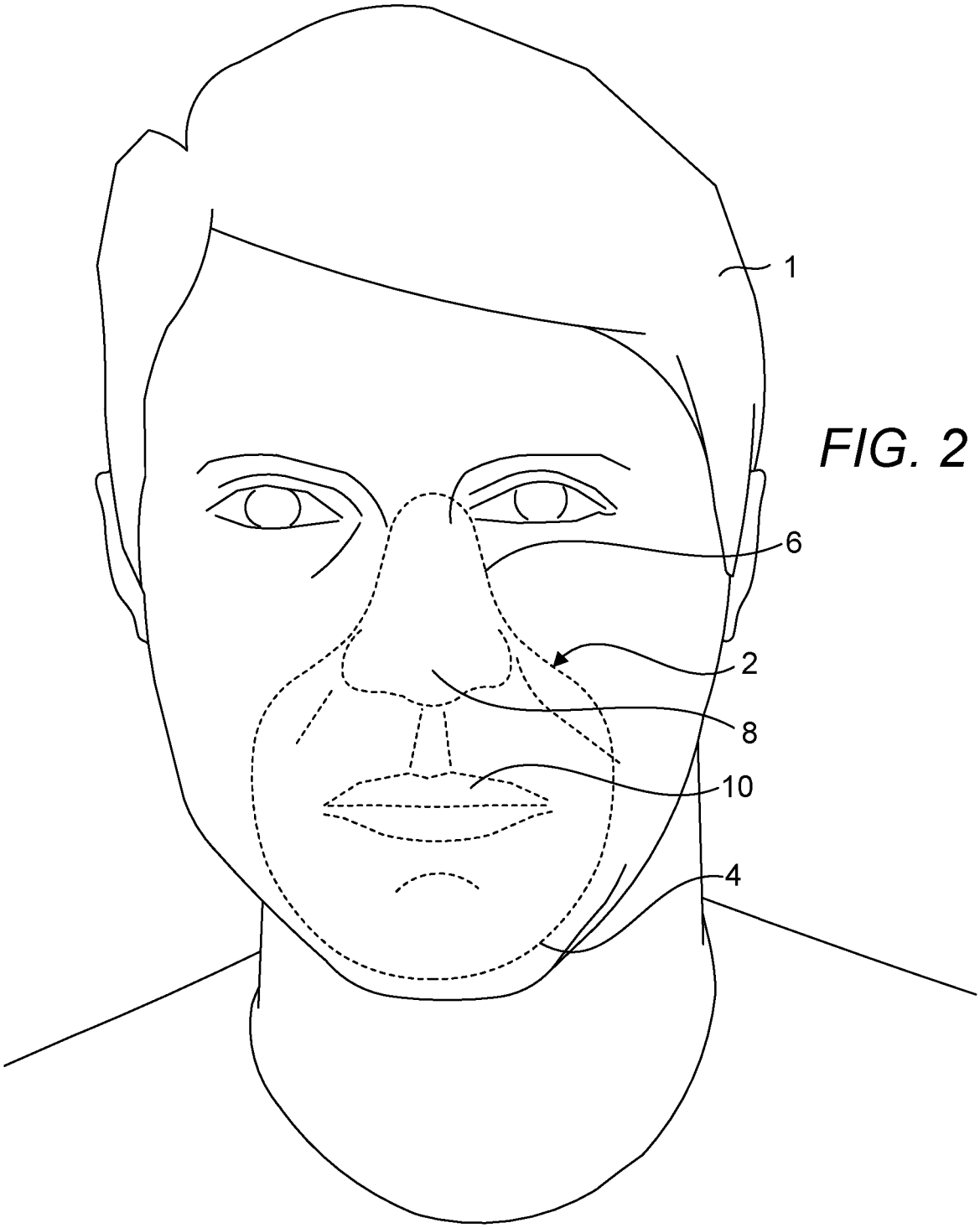
FIG. 2 illustrates a front view of a user, showing pertinent facial features. Delineated is a nose-mouth perimeter produced by the individual geometries of the user's nose and mouth and positional relationship thereof.

FIG. 2 illustrates a front view of user 1, showing pertinent facial features. Delineated is nose-mouth perimeter 2 produced by the combination of the geometries associated with user's nose 8 and mouth 10 and positional relationship thereof. Nose-mouth perimeter 2 is comprised of two contiguous portions, an upper and a lower portion. The upper portion of nose-mouth perimeter 2 is comprised of nasal periphery 6, while the lower portion is comprised of mouth periphery 4.

Figure 3:
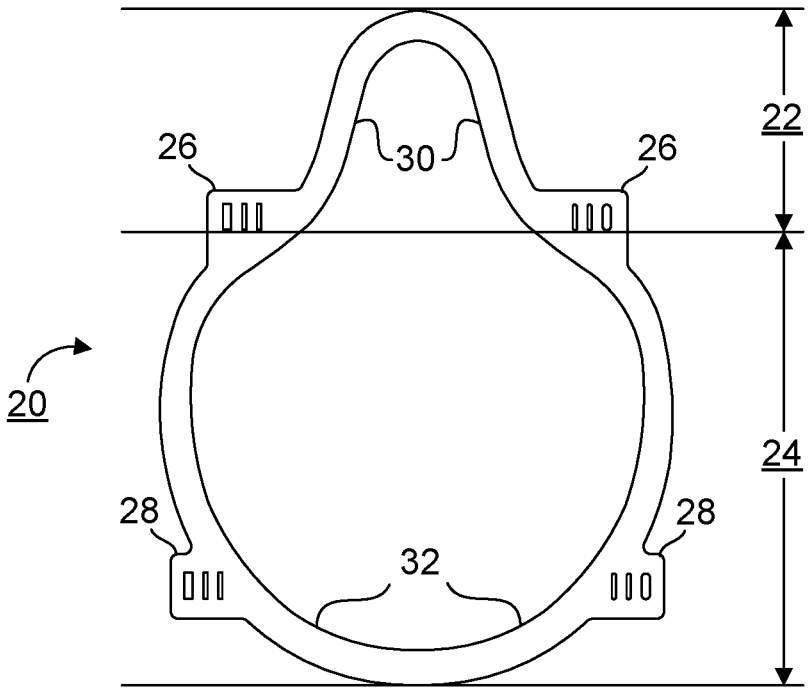
FIG. 3 illustrates a front view of an exemplary CER shown in FIG. 1. The CER device includes four attachment features, wherein each attachment features is comprised of three apertures (tri-aperture attachment).

FIG. 3 illustrates a front view of an exemplary, CER 20 shown in FIG. 1. Exemplary CER 20 is comprised of an upper curvilinear portion 22 and a lower curvilinear portion 24. Upper curvilinear portion 22 possesses nasal curvature 30 based upon nasal periphery 6. Lower curvilinear portion 24 possesses mouth curvature 32 based upon mouth periphery 4. It is understood that the present invention can include variations of CER 20 that can accommodate the various nasal curvatures 30 and mouth curvatures 32 present in the user population. In certain embodiments of the present invention, a variety of sizes (e.g., small, medium and large) is an exemplary means for accommodating variations in the user population. Furthermore, an entire interior of the CER 20 is voided of material.

CER 20 includes four attachment features, two upper attachment features 26 and two lower attachment features 28. In this exemplary attachment configuration, each of the attachment features is comprised of three apertures configured as slots (tri-aperture attachment).

Figure 4:
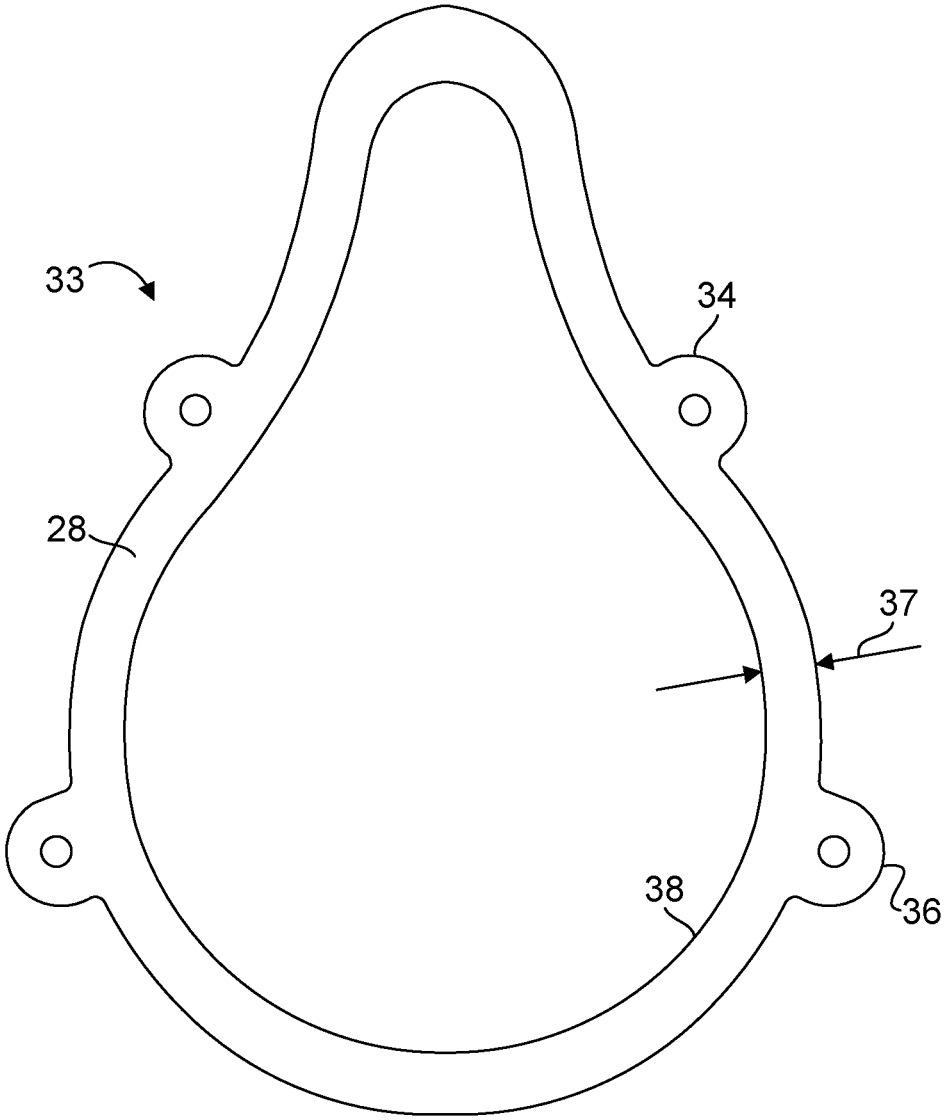
FIG. 4 illustrates a front view of an alternate embodiment of a CER including four attachment features, wherein each aperture is comprised of a single circular aperture.

FIG. 4 illustrates a front view of an alternate embodiment of an exemplary CER 33. CER 33 includes outside surface 28, which faces away from user 1, perimeter strip 38 and possesses device width 36. CER 33 includes four attachment features, wherein each feature is includes a single circular aperture. The attachment features include upper pair attachment features 34 and lower pair attachment features 36. The circular apertures lend themselves to support-type straps having circular cross-sections, such as cords and rope type materials, wherein a distal-end knot is capable of capturing such a strap onto attachment feature 34.

Preferred CER embodiments, such as CER 33, CER 20 and the like, can be fabricated using a variety of manufacturing processes, including, but not limited to additive manufacturing processes (3D printing), CNC machining a sheet of polymeric material, die-cutting, or injection molding. Exemplary polymeric type materials, which can be tailored to possess semi-rigid properties, include, but are not limited to TPU (thermoplastic polyurethane), TPE (thermoplastic elastomers) and the Polyvinyl family of polymers.

Figure 5:
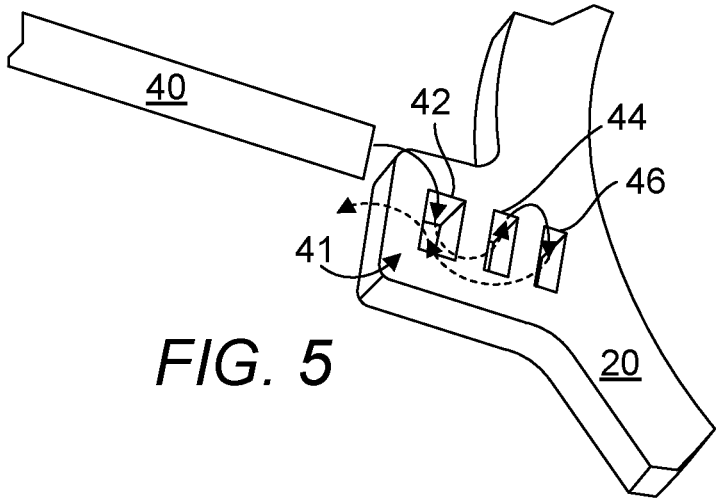
FIG. 5 illustrates a support strap and perspective view of a tri-aperture attachment feature, delineating a method of fastening a support strap.
Figure 6:
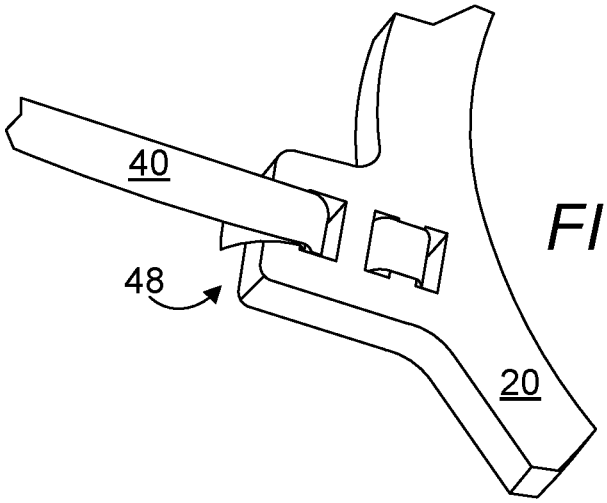
FIG. 6 illustrates a perspective view of a support strap fastened onto a tri-aperture attachment feature using the method delineated in FIGS. 5 and 7.
Figure 7:
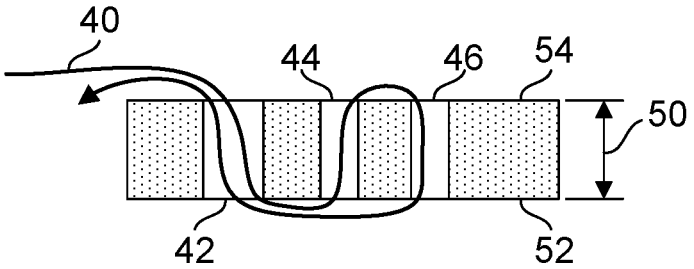
FIG. 7 illustrates a cross-sectional view of a tri-aperture attachment feature further delineating the aforementioned method of fastening a support strap.

FIGS. 5, 6 and 7 illustrate the exemplary upper and lower attachment features 26 and 28, each having a tri-aperture 41 strap attachment system having three rectangular slots, i.e., first slot 42, second slot 44 and third slot 46. FIG. 5 illustrates a perspective view of a tri-aperture 41 attachment feature, delineating a method of fastening support strap 40. Accordingly, the strap directional arrows delineate as follows: strap 40 is inserted into the front face of wider first slot 42, then fed through the back side of second slot 44, followed by reinsertion through the front face of third slot 45 and finalized by insertion through the back side of first slot 42. FIG. 6 illustrates a perspective view of support strap 40 successfully fastened onto a tri-aperture 41 attachment feature using the method delineated in FIG. 5. It is important to note that the process of fastening support strap 40 onto tri-aperture 41 strap attachment system does not require any tool or tools and can be manually connected by the user or the like.

FIG. 7 illustrates a cross-sectional view of tri-aperture 41 attachment feature. The figure delineates in cross-sectional detail the method of fastening support strap 40 shown in FIG. 5. Also depicted is thickness 50 of CER 20, as well as user's side 52 surface and outside face 54, i.e., the surface directed away from the user. In an exemplary embodiment of CER 20, width 37 dimension is approximately four times larger than thickness 50.

Figure 8:
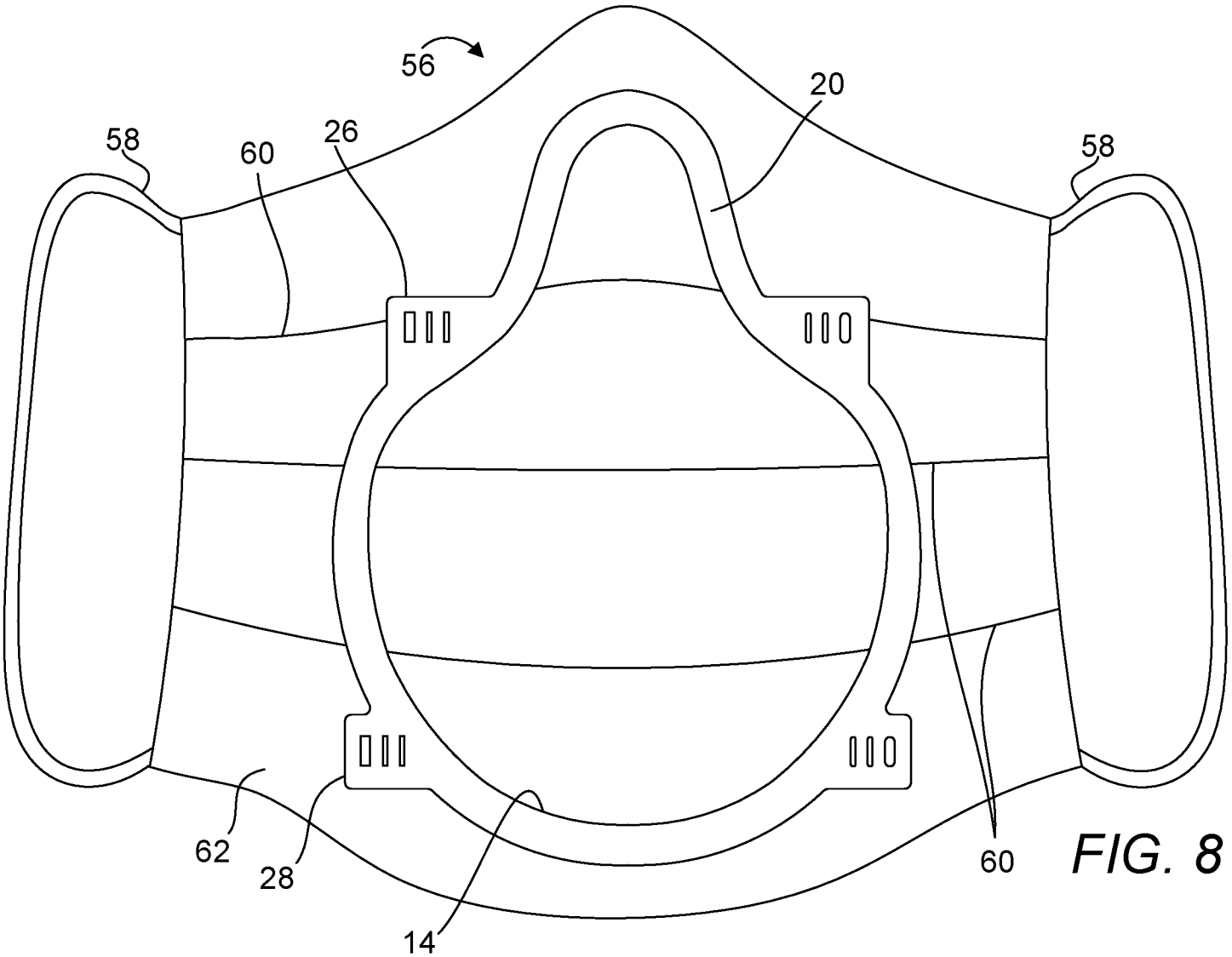
FIG. 8 illustrates a front view of an exemplary CER engaging the front face of surgical face mask.

FIG. 8 illustrates a front view of CER 20 engaging the front surface 62 of surgical face mask 56. Surgical face mask 56 possesses a series of pleats 60, typically found on surgical type face mask type designs. In such configurations, the use of the surgical face mask's ear loop 58 is optional, since CER 20 provides sufficient support to affix the filtration textile portion of surgical face mask 56 onto the user. CER 20 system including support straps 40, additionally provide a backup means of securing surgical face mask 56 onto the user, which will provide adequate support in the event of ear loops 58 failures.

Figure 9:
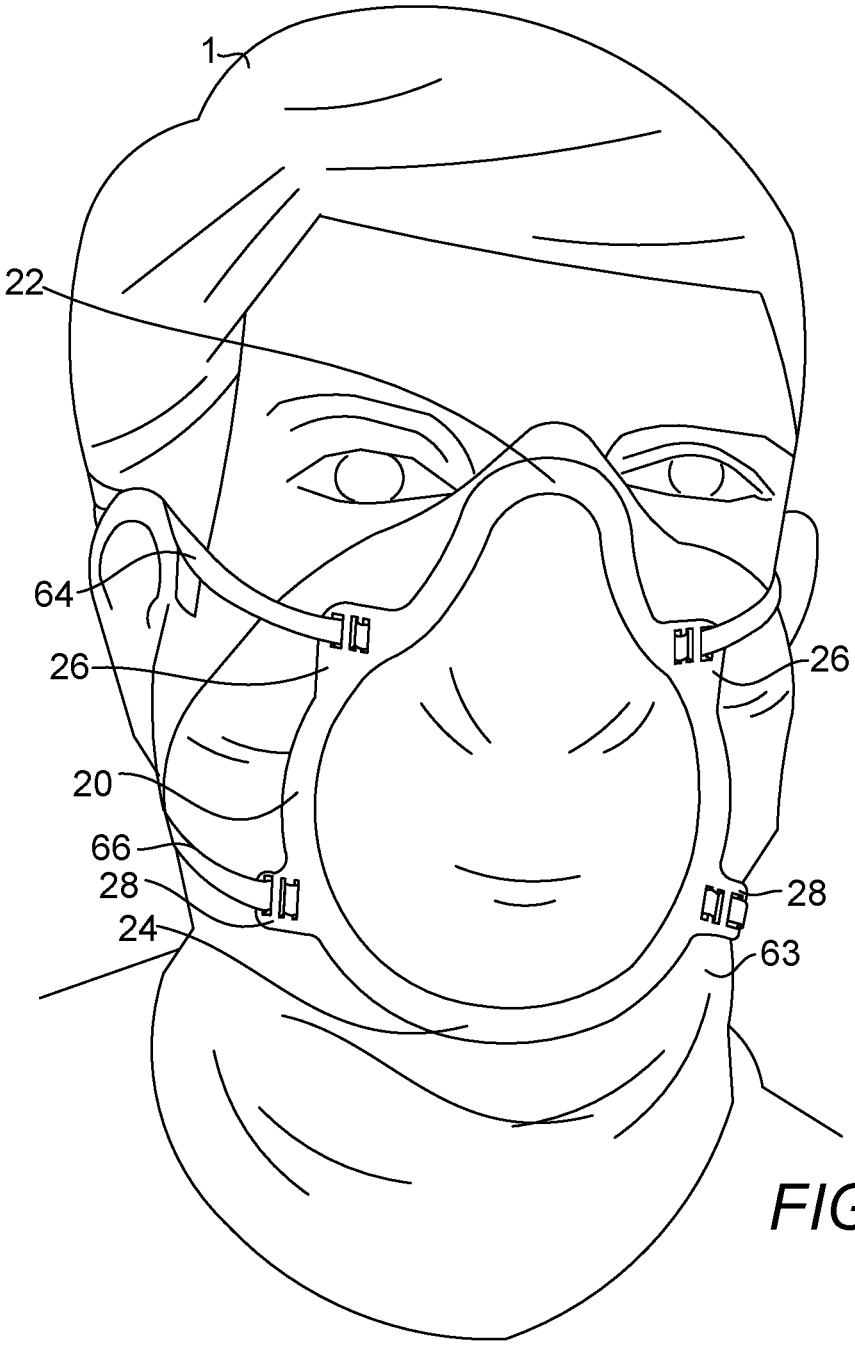
FIG. 9 illustrates a front view of a sheet type of filtration textile, in the form of a handkerchief, affixed to a user. A CER further engages the outside surface of the handkerchief, further engaging the perimeter about the user's nose-mouth area. The CER includes upper and lower support straps fastened onto the four corresponding CER tri-aperture attachment features.
Figure 10:
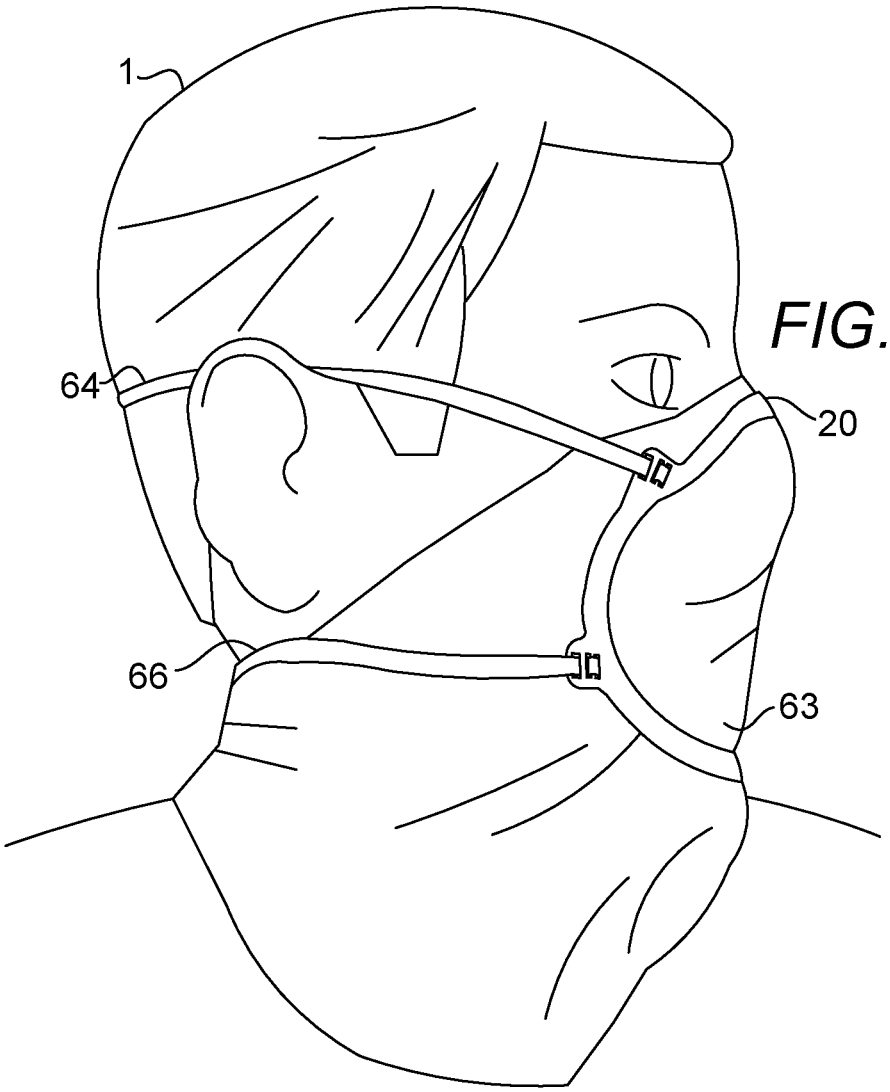
FIG. 10 illustrates a side view of a sheet type of filtration textile affixed to a user by a CER shown in FIG. 9.

FIGS. 9 and 10 respectively illustrate front and side views of a sheet-type of filtration textile, depicted in the form of exemplary handkerchief 63 affixed to user 1. Handkerchief 63 is one example of many possible types of filtration textiles, as defined in the present disclosure. Handkerchief 63 is self-affixed onto user 1, covering the nose-mouth areas. Engagement perimeter 14 provided by CER 20 produces additional focused engagement pressure to nose-mouth perimeter 2, which is transmitted through the outside surface of handkerchief 63. CER 20 includes upper attachment features 26 with attached upper support strap 64. Upper support strap 64 is affixed to the head of user 1, just over the ears. CER 20 also includes lower attachment features 28 with attached lower support strap 66. Lower support strap 66 is affixed to the head of user 1, below the ears. Upper and lower support straps 64 and 66 in preferred embodiments can be fabricated from either elastic as well as inelastic type materials.

It is understood that filtration textiles 12 can vary in construction. In certain preferred embodiments, the filtration textile 12 is fabricated from a single sheet or layer of filtration material. In other embodiments the filter component can be constructed from two or more layers of filtration material to enhance the filtration capability of the system. In multi-layered embodiments, outer edge portions of each layer can be optionally fastened to each other, such that the multi-layered filtration material can be handled as one single unit for convenience.

Figure 11:
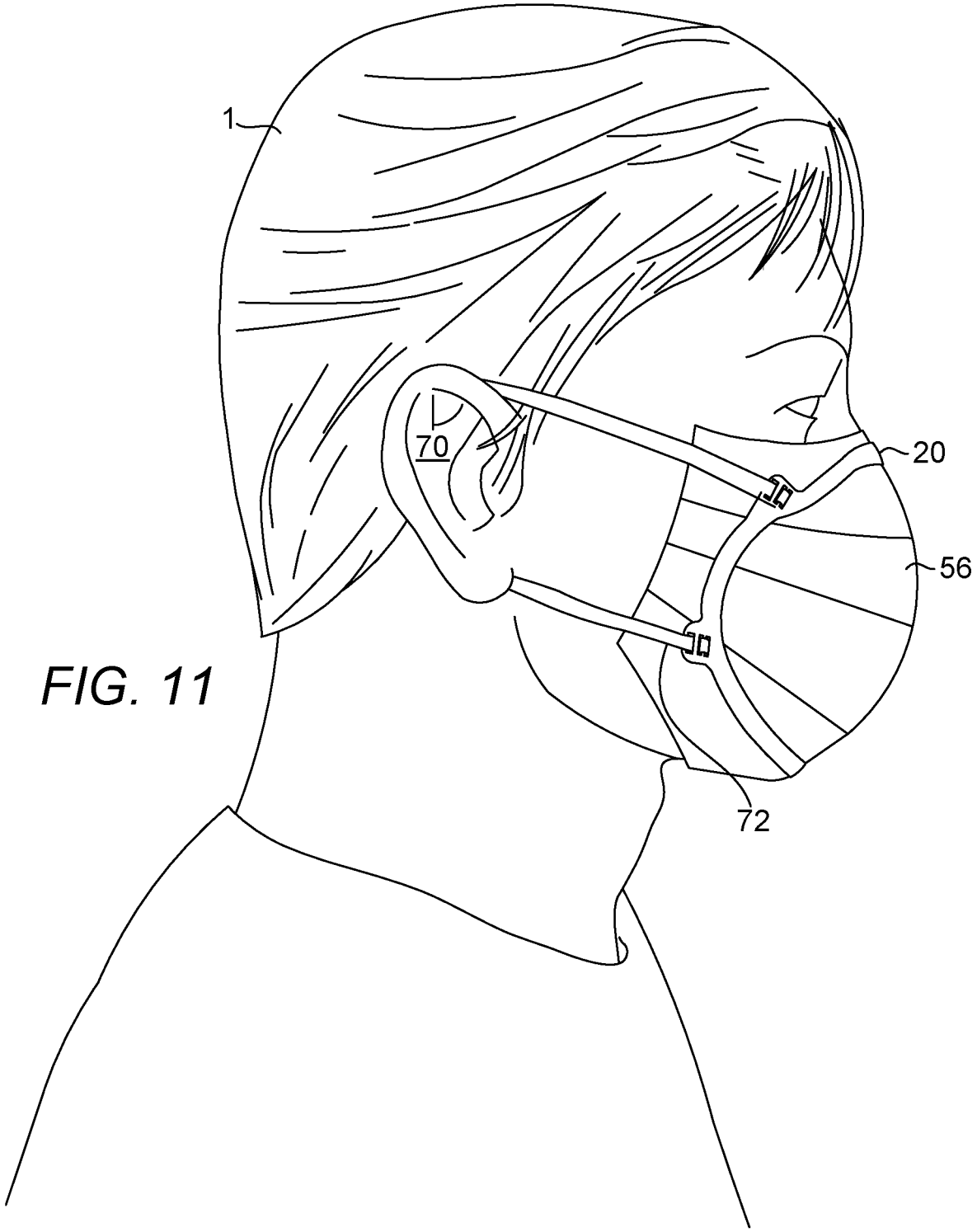
FIG. 11 illustrates a side view of a surgical face mask affixed to a user by a CER. The CER is supported by right and left ear loops, configured to engage the user's ears.

FIG. 11 illustrates a side view of surgical face mask 68 affixed to user 1 by CER 20 system. The CER 20 is supported by right and left ear loops 72, both configured to engage user's ears 70. In the embodiment shown, surgical face mask 68 does not possess any attached or integrated means of support, therefore surgical face mask 68 completely relies on CER 20 system for user-filter attachment support.

Figure 12:
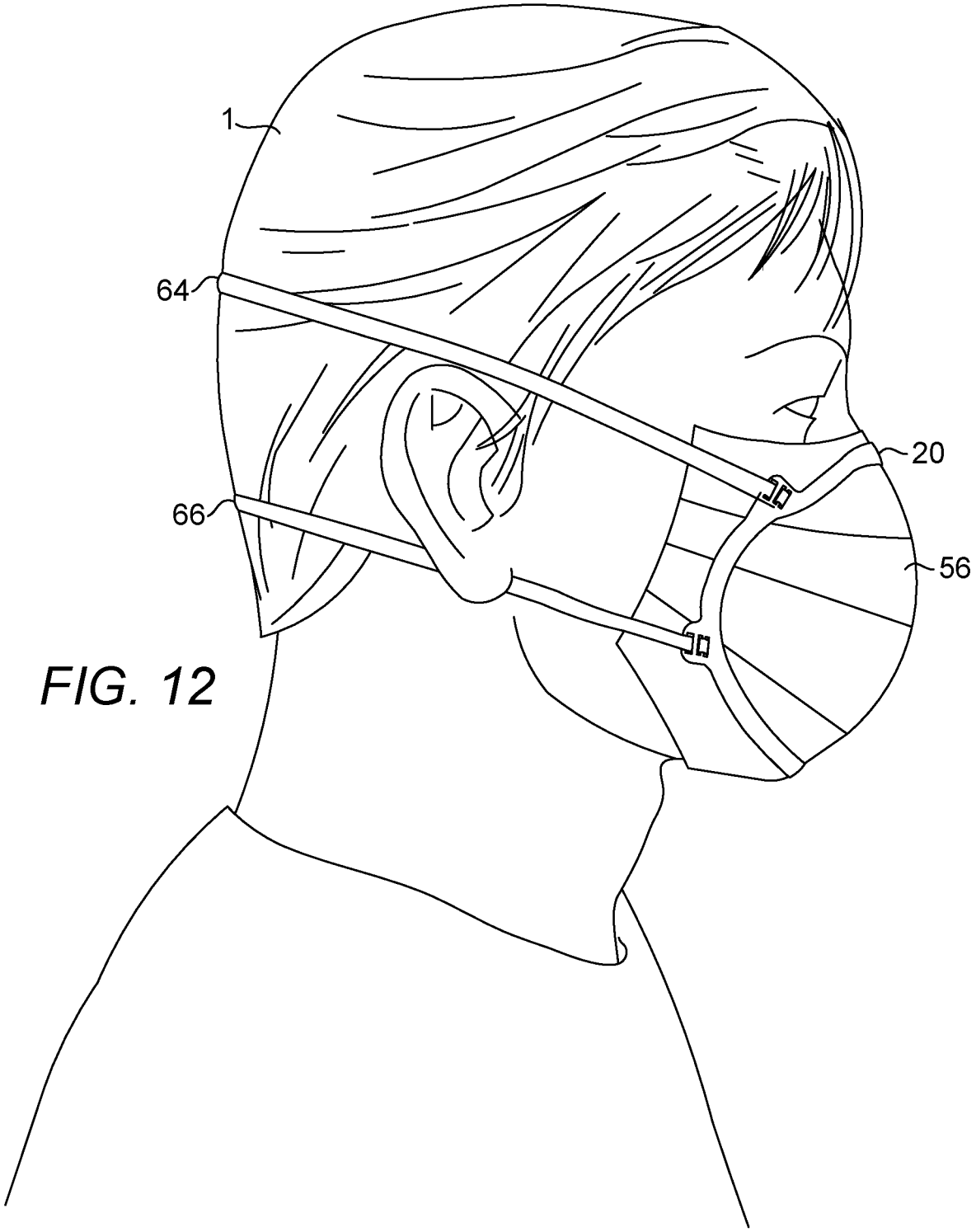
FIG. 12 illustrates a side view of a surgical face mask affixed to a user by a CER. The CER is supported by an upper and a lower support strap, both straps are configured to engage the back portion of the user's head.

FIG. 12 illustrates a side view of surgical face mask 68 affixed to user 1 by CER 20 system. In this embodiment, CER 20 is supported by respective upper and lower support straps 64 and 66, both configured to engage the back portion of the user's 1 head.

Again, in the embodiments shown in both FIGS. 11 and 12, the surgical face mask 68 does not possess any attached or integrated means of support, therefore surgical face mask 68 completely relies on CER 20 system for user-filter engaging support.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized and changes may be made without departing from the scope of the disclosed embodiments. The various embodiments can be combined with one or more other embodiments to form new embodiments. The detailed description is, therefore, not to be taken in a limiting sense and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative and not restrictive and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. A continuous elongated ring configured to engage a filtration textile to a nose-mouth perimeter of user, wherein the continuous elongated ring is configured to conform to the users nose and mouth, said continuous elongated ring comprising a flexible outer edge surrounding an empty inner portion adapted to retain said filtration textile, wherein an entirety of the empty inner portion is voided of material, wherein the continuous elongated ring is distinct and separate from the filtration textile and is configured to affix the filtration textile onto the user, the flexible outer edge comprising:

(a) an upper curvilinear portion adapted to engage said filtration textile disposed about a nasal periphery of the user; said upper curvilinear portion comprising a pair of attachment features, wherein the pair of attachment features comprise at least three elongated slots and are adapted to fastenly receive an upper support strap configured to engage the user's head; and (b) a lower curvilinear portion adapted to engage said filtration textile disposed about a mouth periphery of the user; said lower curvilinear portion comprising a pair of attachment features, wherein the pair of attachment features comprise at least three elongated slots and are adapted to fastenly receive a lower support strap configured to engage the user's head wherein the support straps are configured to be inserted into a first and a second slot of the at least three elongated slots.

2. The continuous elongated ring of claim 1, further comprising a user's side, wherein said user's side includes a spongy material attached onto a least a portion of said user's side to provide enhanced engagement between said filtration textile and said nose-mouth perimeter of the user.

3. The continuous elongated ring of claim 1, wherein said continuous elongated ring is configured to engage said filtration textile about said nose-mouth perimeter of the user so to create a substantially sealed inner volume disposed between said filtration textile and the user.

4. The continuous elongated ring of claim 1, further comprising said filtration textile, wherein said filtration textile is constructed from a material selected from the group consisting of a loose fitting face mask, a sheet of pathogenic protective filtration material, a sheet of particulate protective filtration material, a sheet of permeable fabric and any combinations thereof.

5. The continuous elongated ring of claim 4, wherein said continuous elongated ring is configured to engage said filtration textile about said nose-mouth perimeter of the user so to create a substantially sealed inner volume disposed between said filtration textile and the user.

6. The continuous elongated ring of claim 1, wherein said pair of attachment features of said upper curvilinear portion comprise said upper support strap.

7. The continuous elongated ring of claim 1, wherein said pair of attachment features of said lower curvilinear portion comprise said lower support strap.

8. A continuous elongated ring configured to engage a filtration textile to a nose-mouth perimeter of a user, wherein the continuous elongated ring is configured to conform to the users nose and mouth, said continuous elongated ring comprising a flexible outer edge surrounding an empty inner portion adapted to retain said filtration textile, wherein an entirety of the empty inner portion is voided of material, wherein the continuous elongated ring is distinct and separate from the filtration textile and is configured to affix the filtration textile onto the user, the flexible outer edge comprising:

(a) an upper curvilinear portion adapted to engage said filtration textile disposed about a nasal periphery of the user; said upper curvilinear portion comprising a first upper attachment feature and a second upper attachment feature, wherein each of said first upper attachment feature and said second upper attachment feature comprises at least three elongated slots and is adapted to fastenly receive an upper support strap; and (b) a lower curvilinear portion adapted to engage said filtration textile disposed about a mouth periphery of the user; said lower curvilinear portion comprising a first lower attachment feature and a second lower attachment feature, wherein each of said first attachment feature and said second attachment feature comprises at least three elongated slots and is adapted to fastenly receive a lower support strap wherein the support straps are configured to be inserted into a first and a second slot of the at least three elongated slots.

9. The continuous elongated ring of claim 8, further comprising a user's side, wherein said user's side includes a spongy material attached onto a least a portion of said user's side to provide enhanced engagement between said filtration textile and said nose-mouth perimeter of the user.

10. The continuous elongated ring of claim 8, wherein said continuous elongated ring is configured to engage said filtration textile about said nose-mouth perimeter of the user so to create a substantially sealed inner volume disposed between said filtration textile and the user.

11. The continuous elongated ring of claim 8, wherein at least one of said first upper attachment feature and said second upper attachment feature further comprises said upper support strap fastenly received thereon.

12. The continuous elongated ring of claim 8, further comprising said filtration textile, wherein said filtration textile is constructed from a material selected from the group consisting of a loose fitting face mask, a sheet of pathogenic protective filtration material, a sheet of particulate protective filtration material, a sheet of permeable fabric and any combinations thereof.

13. The continuous elongated ring of claim 8, wherein at least one of said first lower attachment feature and said second lower attachment feature further comprises said lower support strap fastenly received thereon.

* * * * *